US010578404B2

(12) United States Patent
Swan

(10) Patent No.: US 10,578,404 B2
(45) Date of Patent: Mar. 3, 2020

(54) MOUNTING ASSEMBLY WITH METAL INJECTION MOLDED LEVER AND SELECTIVE THREADED GOVERNOR POST

(71) Applicant: Richard E. Swan, E. Bridgewater, MA (US)

(72) Inventor: Richard E. Swan, E. Bridgewater, MA (US)

( * ) Notice: Subject to any disclaimer, the term of this patent is extended or adjusted under 35 U.S.C. 154(b) by 99 days.

(21) Appl. No.: 15/613,953

(22) Filed: Jun. 5, 2017

(65) Prior Publication Data

US 2018/0347950 A1 Dec. 6, 2018

(51) Int. Cl.
*F41G 11/00* (2006.01)

(52) U.S. Cl.
CPC ..... *F41G 11/003* (2013.01)

(58) Field of Classification Search
CPC ..... F41G 11/003
USPC ..... 42/90
See application file for complete search history.

(56) References Cited

U.S. PATENT DOCUMENTS 1,428,655 A 9/1922 Noske
2,101,037 A 12/1937 O'Neil
2,161,051 A 6/1939 Humeston
3,877,166 A 4/1975 Ward
4,328,624 A * 5/1982 Ross ..... F41G 11/003 42/124
4,845,871 A 7/1989 Swan
4,860,480 A 8/1989 Ruger
4,905,396 A 3/1990 Bechtel
5,155,915 A 10/1992 Repa
5,276,988 A 1/1994 Swan
5,606,818 A 3/1997 Hardee
5,653,034 A 8/1997 Bindon
5,669,173 A 9/1997 Rodney, Jr.
5,680,725 A 10/1997 Bell
5,881,486 A * 3/1999 Bilgeri ..... F41G 11/003 42/124
6,295,754 B1 * 10/2001 Otteman ..... F41G 1/38 42/111
6,442,883 B1 9/2002 Waterman et al.
6,449,893 B2 9/2002 Spinner
6,490,822 B1 12/2002 Swan
6,513,276 B2 2/2003 Mendoza-Orozco
(Continued)

OTHER PUBLICATIONS

TM 9-4931-710-14&P, Technical Manual, Operator, Organizational, Direct Support and General Support Maintenance Manual, Headquarters, Department of the Army, Aug. 1986.

*Primary Examiner* — Stephen Johnson
*Assistant Examiner* — Benjamin S Gomberg
(74) *Attorney, Agent, or Firm* — Barlow, Josephs & Holmes, Ltd.

(57) ABSTRACT

An improved mounting assembly is provided that is configured to be releasably attached to a dovetail rail profile, wherein the clamping tension of the clamping actuator is adjustable. The assembly includes a molded foot portion and a turned steel threaded governor post which provides superior strength and durability to a critical stress point in the assembly. The threaded, removable governor post configuration also provides the ability to change the post material to increase overall component strength and to increase thread strength. The arrangement further simplifies field maintenance and repair in the event of damage and reduces repair costs by not having to replace the entire lever assembly.

18 Claims, 10 Drawing Sheets

(56) References Cited

U.S. PATENT DOCUMENTS

| | | | | |
|---|---|---|---|---|
| 6,598,333 | B1 | 7/2003 | Randazzo et al. | |
| 6,622,415 | B1 | 9/2003 | Canaday et al. | |
| 6,922,934 | B1 | 8/2005 | Huan | |
| 6,931,778 | B1 | 8/2005 | Nelson et al. | |
| 7,272,904 | B2 * | 9/2007 | Larue | F41G 11/003 292/145 |
| 7,757,422 | B1 * | 7/2010 | Swan | F41C 23/16 403/374.5 |
| 7,886,476 | B1 * | 2/2011 | Swan | F41C 27/00 403/374.5 |
| 7,905,045 | B1 * | 3/2011 | Swan | F41G 11/003 403/374.5 |
| 8,112,933 | B1 * | 2/2012 | Swan | F41G 11/003 403/374.5 |
| 8,205,375 | B1 * | 6/2012 | Swan | F41G 1/38 42/124 |
| 8,347,540 | B2 * | 1/2013 | Sirois | F41C 23/16 42/71.01 |
| 8,429,845 | B1 * | 4/2013 | Swan | F41G 11/002 42/124 |
| 8,650,794 | B2 * | 2/2014 | Swan | F41C 33/007 42/106 |
| 2004/0148842 | A1 | 8/2004 | Aalto et al. | |
| 2006/0123686 | A1 | 6/2006 | Larue | |
| 2006/0207156 | A1 * | 9/2006 | Larue | F41G 11/003 42/127 |
| 2008/0092425 | A1 | 4/2008 | Keng | |
| 2008/0155876 | A1 * | 7/2008 | Matthews | F41G 11/003 42/124 |
| 2008/0168696 | A1 | 7/2008 | Orne et al. | |
| 2008/0175851 | A1 | 7/2008 | Storch et al. | |

* cited by examiner

MOUNTING ASSEMBLY WITH METAL INJECTION MOLDED LEVER AND SELECTIVE THREADED GOVERNOR POST

BACKGROUND OF THE INVENTION

The present invention relates generally to modular integrated accessory mounting assemblies for combat weapons. More specifically, the present invention relates to an accessory mounting assembly, which includes an actuator that provides adjustable spring tension to control the clamping force exerted by the actuator against the firearm interface rail, and which provides added tensile strength for the threaded governor post.

As the field of combat and commercial weaponry expands, numerous add-on enhancements have become available for attachment to standard firearms, thereby upgrading the capability of the firearm. Of particular interest in the area of combat weapons is the well-known M16/M4 weapon system (M16 and M4 are trademarks of Colt Defense, Inc.) and the civilian AR15 platform. Generally, the M16/M4/AR15 weapon 2, as depicted in FIG. 1, includes a lower receiver 4, upper receiver 6, butt stock 8, and barrel 10.

The newer models of the M16/M4/AR15 weapons include a mil-std 1913 dovetail rail 12 extending along the top of the upper receiver. This integrated receiver rail 12 provides a mounting point for many types of enhancement devices such as iron sights, optical scopes, laser sights and other sighting devices. However, space on the upper receiver rail 12 is limited, and users often have multiple sighting devices that are each tailored to perform in different situations.

Responding to this need, the applicant has developed a modular integrated rail system (A.R.M.S.® S.I.R.® system) shown at FIG. 2, and fully described in U.S. Pat. No. 6,490,822, the entire contents of which are incorporated herein by reference. These modular integrated rail systems generally include an upper hand guard 14, a means 16 for securing the upper hand guard 14 to the weapon 2, a lower firearm accessory 18 (in most cases this is a lower hand guard), various optional rail segments, and in many cases, a sling swivel 20 for attaching a shoulder sling to carry the weapon 2.

An interface means 16 is provided at the rearward end of the upper hand guard 14 to removably secure the upper hand guard 14 to the firearm 2. In the original S.I.R. system as shown in U.S. Pat. No. 6,490,822, the interface includes elongated sleeve that secures the upper hand guard 14 to the dovetail rail 12 on the top of the upper receiver 6 of the weapon 2 as well as a U-shaped yoke or clamp (not shown) that secured the upper hand guard 14 to the barrel nut of the weapon. In the other S.I.R. systems, the interface means 16 is a larger U-shaped yoke or clamp that secures the upper hand guard 14 exclusively to the barrel nut with the upper rail 22 sitting flush with the receiver rail 12.

As is well known in this area, field modification of weapon configurations is critical in combat situations. In this regard, standardized attachment assemblies have been developed to allow quick and easy removal and mounting of these devices relative to the dovetail rails.

Such an attachment device is disclosed in U.S. Pat. No. 5,276,988, issued on Jan. 11, 1994 to the present applicant, the contents of the '988 patent being incorporated herein by reference. Generally, the prior art attachment assemblies as shown at FIGS. 3 and 4 include a main body 24 having a lower portion that is configured to engage the dovetail rail 22 on the upper receiver or handguard and an upper portion 26 that can take on a variety of configurations depending on the accessory that is to be mounted thereon. The lower portion of the mounting assembly has a first engagement member 28 extending downwardly along one side thereof for engaging one side of the dovetail rail 22. Further, a boss formation 30 is provided adjacent the side of the main body to receive a clamping assembly 32 that is particularly suited to be releasably engaged with a second side of the dovetail rail 22 such that the clamping assembly cooperates with the first engagement member 28 to retain the modular mounting assembly in its installed position on the dovetail rail. The clamping assembly 32 generally includes a foot portion 32A with a cam surface 32B to engage the angulated surface of the dovetail rail 22, a post (not shown) extending upwardly through the boss formation 30 and a head portion 32C secured to the top end of the post and having actuator arm 32D to facilitate rotation of the foot portion 32A. The clamping assembly 32 further includes spring washers (not shown), which are captured between the bottom surface of the head portion 32C and the boss 30 (or a bushing within the boss) to provide a self-adjusting amount of spring tension as the clamping assembly 32 is rotated into engagement with the rail 22. These springs generally allow a limited, self-adjusted amount of biased vertical movement of the clamping foot 32A relative to the boss and the rail 22. Because the head portion 32C of the clamping assembly 32 is secured in a fixed position on the top end of the post, the spring are compressed by a fixed amount and therefore the force exerted by the foot 32A on the rail 22 was generally variable, but variable only within a certain range as determined by the initial spring tension. This small range of self-adjustment is critical in being able to accommodate the small dimensional variations allowed mil-std 1913 rail configuration.

As the commercial AR-15 marketplace increased over the last 15 years, many commercial manufacturers loosened their tolerances for the mil-std 1913 dovetail dimensions resulting in dovetail rails that do not meet the mil-std 1913 specifications and which are both larger and smaller than the mil-std 1913 dimensions. These small changes in tolerance meant that the fixed spring variance in the earlier versions of the mounting assemblies often did not fit correctly onto the non-mil-std 1913 dimensioned rails.

Accordingly, in the commercial market there is a need to adjust the range of the spring tension. However, making this adjustment available to the end user often leads to overtightening and physical damage to both the rails and the mounting assemblies. Overtight is not better in these circumstances.

Accordingly, there is a need for a modular mounting assembly that includes an ability to adjust the spring tension that is exerted by the clamping foot while also providing superior strength and reliability in the field.

BRIEF SUMMARY OF THE INVENTION

In this regard, the present invention provides for an improved mounting assembly that is configured to be releasably attached to a standard dovetail rail profile wherein the clamping tension of the clamping assembly is adjustable and which provides a strengthened construction.

The mounting assembly of the present invention generally includes a main body having a lower portion that is configured to engage the dovetail rail found on most modern combat weapons as depicted in FIG. 1 and an upper portion that can take a variety of configurations depending on the accessory that is to be mounted thereon. A boss formation including an opening extends outwardly to the side of the main body. A bushing including a central opening is mounted within the opening of the boss formation. The lower portion of the main body has a first engagement member extending downwardly along one side thereof for engaging one side of the dovetail rail.

An exemplary embodiment provides an improved clamping assembly that comprises a foot portion positioned adjacent the bottom surface of the boss formation and an actuator arm extending from the foot portion. The foot portion includes a cam surface similar to the prior art foot portion. A threaded governor post received through a threaded bore of the foot portion extends upwardly through the opening in the bushing. In an exemplary method of manufacture, the foot and actuator arm portions are molded using a technique known as metal injection molding or (MIM), while the threaded governor post is turned from a stainless steel blank. In the prior art, the threaded governor post was integrally molded with the foot portion. However, in certain cases of severe overtightening by the end user, this was occasionally a point of weakness for the earlier devices. The stainless steel governor post in the present invention now provides the same functionality and ease of assembly with superior strength and durability. The threaded, removable governor post configuration also provides the ability to change the post material to increase overall component strength and to increase thread strength. The arrangement further simplifies field maintenance and repair in the event of damage and reduces repair costs by not having to replace the entire lever assembly.

At least one spring (such as a Belleville spring washer) is received around the threaded governor post adjacent the upper surface of the bushing, and a retention nut is threaded onto the upper end of the threaded post such that the spring is captured between the bottom surface of the retention nut and the upper surface of the bushing. The spring is compressed as the retention nut is tightened thereby providing for adjustment of the spring tension of the clamping assembly.

To insure that the retention nut remains in the position set by the user, actuator arm includes a threaded locking pin that extends through the actuator arm of the clamping assembly and that engages indexing formations on the outer surface of the retention nut. It is this adjustment in the spring tension that directly translates to the amount of force with which the clamping assembly engages the rail. Should the user wish to adjust the spring tension, the retention nut is turned until the desired spring tension is achieved.

Accordingly, it is an object of the present invention to provide an improved adjustable spring tension mounting assembly that provides superior strength and durability and that can be reliably mounted onto a dovetail rail without failure.

These, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
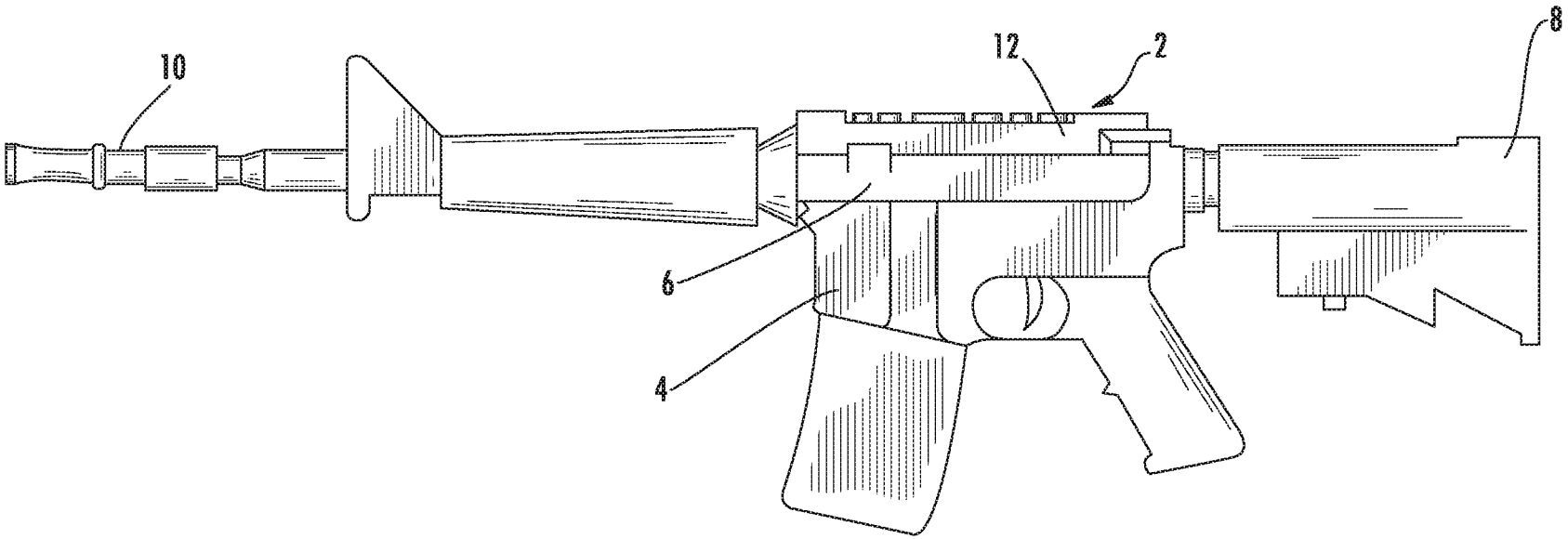
FIG. 1 (PRIOR ART)
FIG. 1 is a side view of a prior art firearm.

Now referring to the drawings, an exemplary embodiment of the present mounting assembly is shown and generally illustrated at 40 in FIGS. 5-12. The mounting assembly 40 is configured to be releasably attached to a standard dovetail rail profile 12 as is depicted in FIG. 1, and includes an adjustment to control the clamping force exerted by the mounting assembly 40 against the dovetail rail 12, as will be discussed in more detail below. The mounting assembly 40 of the present invention is particularly suited for use in connection with any firearm 2 that utilizes a mil-std 1913 dovetail rail 12 or supplemental rail system regardless of whether the rail meets the mil-std 1913 tolerances.

Figure 5:
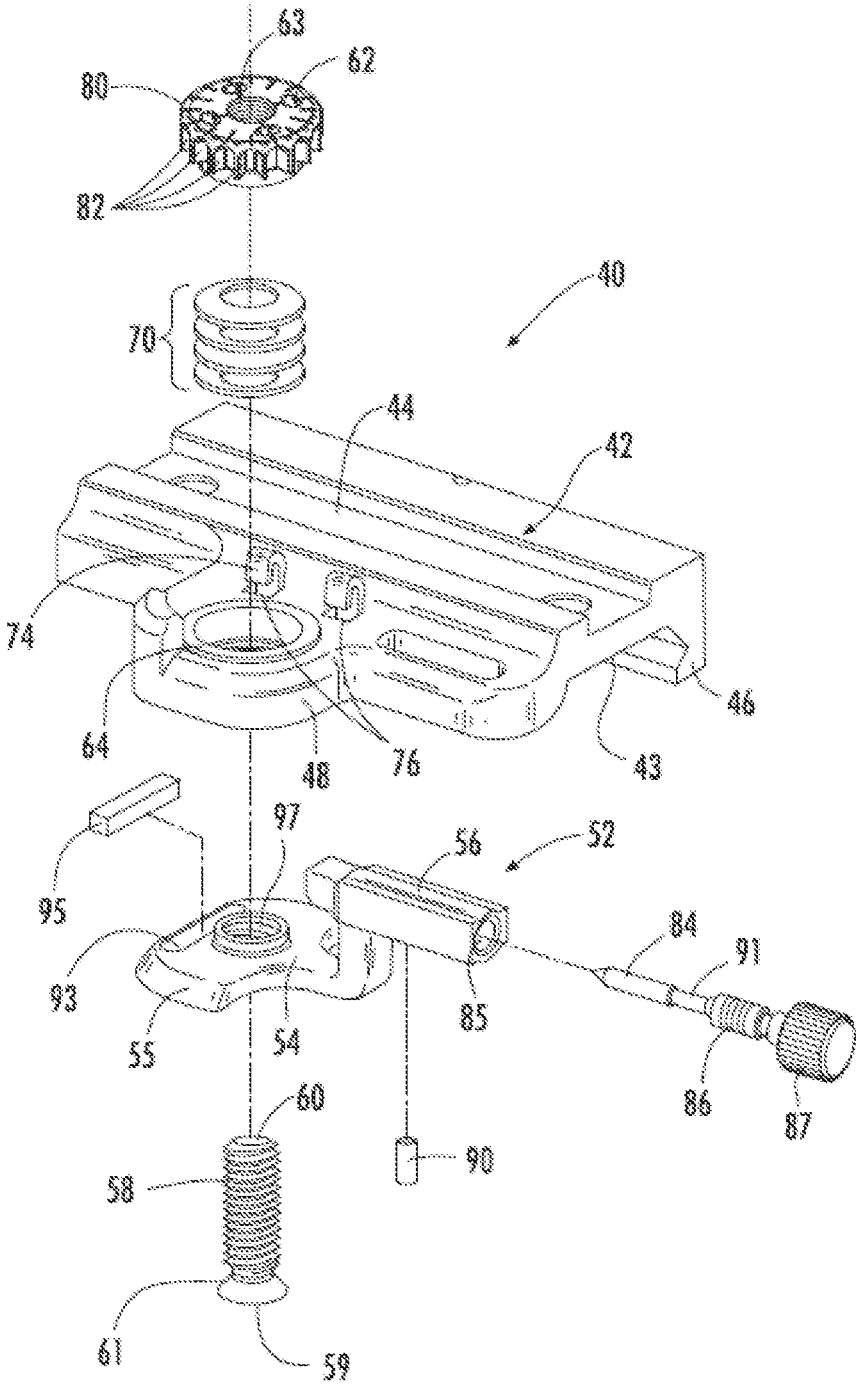
FIG. 5 is an exploded perspective view of an embodiment of the mounting assembly in accordance with the teachings of the present invention.

Turning now to FIG. 5, as can be seen, the mounting assembly 40 includes a main body 42 that is configured in substantially the same manner as a traditional prior art device and further includes a lower portion 43 that is configured to engage the dovetail rail 12 found on most modern combat weapons 2 and an upper portion 44 that can take on a variety of configurations depending on the accessory that is to be mounted thereon. As can best be seen in FIGS. 5-7, the lower portion 43 of the main body 42 has a first engagement member 46 extending downwardly along one side thereof for engaging one side of the dovetail rail 12. Opposite the first engagement member 46, a boss formation 48 is provided adjacent the side of the main body 42 wherein the boss formation 48 includes a large central opening 50 therein to receive a clamping assembly generally indicated at 52. An annular bushing 64 with a smaller central opening 65 is installed into the large central opening 50.

Figure 2:
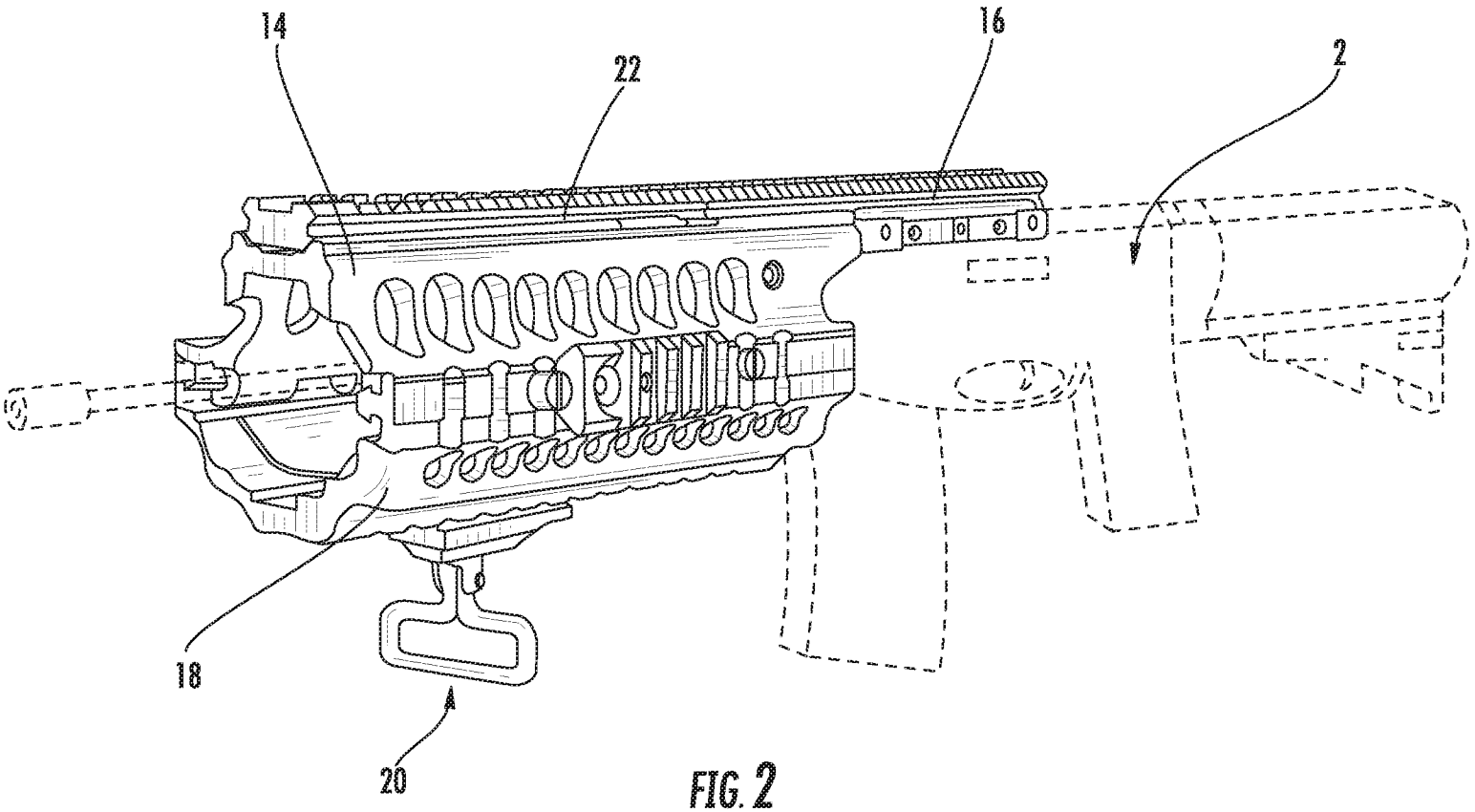
FIG. 2 (PRIOR ART)
FIG. 2 is a perspective view of a prior art rail interface system.
Figure 3:
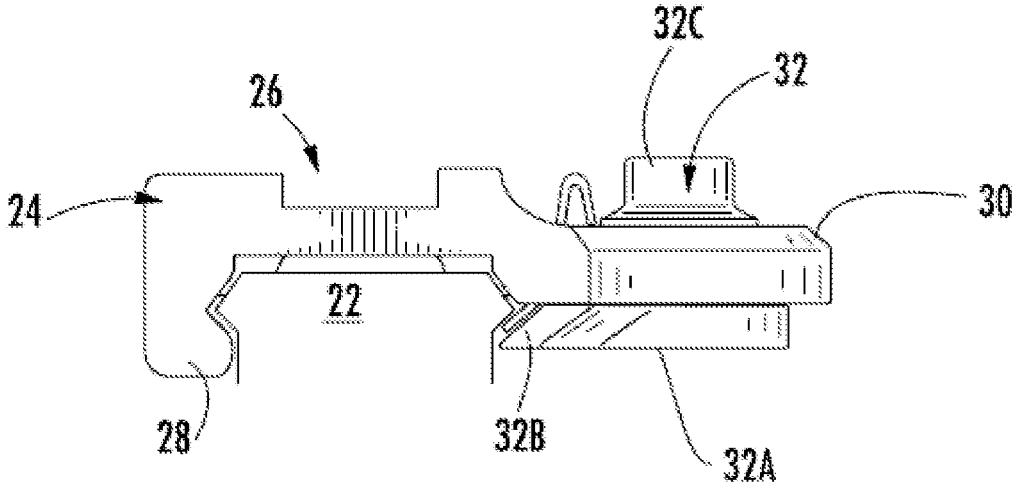
FIG. 3 (PRIOR ART)
FIG. 3 is an end view of a prior art mounting assembly in the engaged position.
Figure 4:
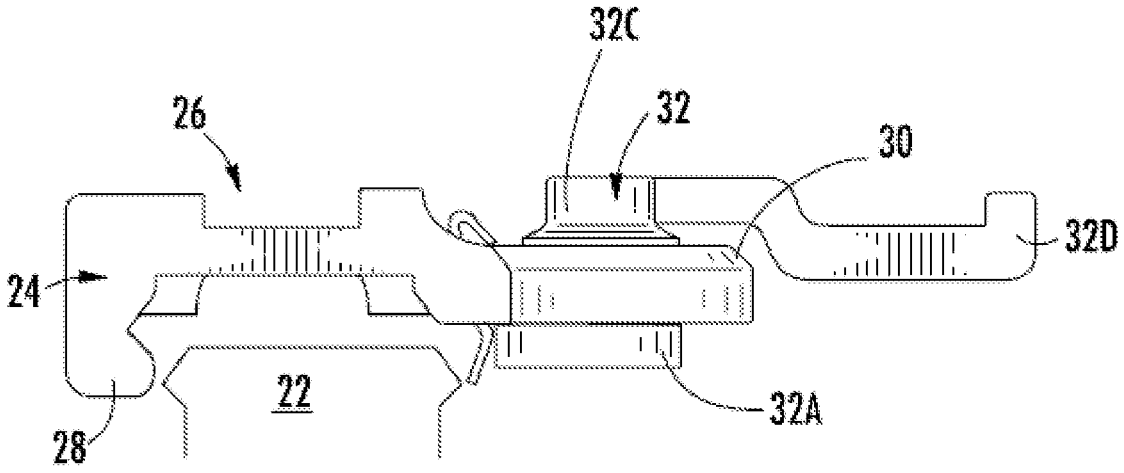
FIG. 4 (PRIOR ART)
FIG. 4 is an end view of a prior art mounting assembly in the disengaged position.

Turning back now to FIG. 5, in the scope of the present invention, the clamping assembly replaces the clamping assembly of the prior art as is depicted in FIGS. 2 and 2*a*. In the present invention, the clamping assembly is configured to releasably engage a dovetail rail interface 12 with a self-adjusting clamping force that has an adjustable range of spring tension. The clamping assembly 52 and the first engagement member cooperate to hold the main body on the dovetail rail 12.

The clamping assembly 52 is received into and supported by the boss formation 48 that extends outwardly from the side of the body 42 of the mounting assembly 40. The clamping assembly 52 generally includes a foot portion 54 that is positioned adjacent the bottom surface of the boss 48 formation. The foot portion 54 includes an angulated cam surface 55 that extends around the side surface of the foot portion 54 as in the prior art devices. The foot portion 54 may be configured as a dual sided foot so that only one foot and arm need be provided for both left and right hand mounting assemblies (as illustrated in the alternative embodiment shown in FIGS. 13 and 14). However, in contrast to the prior art as described, the actuator arm 56 extends outwardly directly from the foot portion 54 below the boss formation 48 rather than being attached to the foot above the boss formation. The actuator arm 56 allows the user to rotate the foot portion 54 thereby selectively rotating the foot portion 54 between engaged and disengaged positions.

The upper surface of the foot portion 54 may also include a recess formed 93 therein, sized and dimensioned to receive a magnet 95 for attracting the steel buffer pad 72, described further below, to the foot portion 54 for easier attaching and detaching the mounting assembly 40 from the rail 12. As indicated in the summary above, the exemplary method of manufacturing for the foot portion 54 is Metal Injection Molding (MIM).

Figure 6:
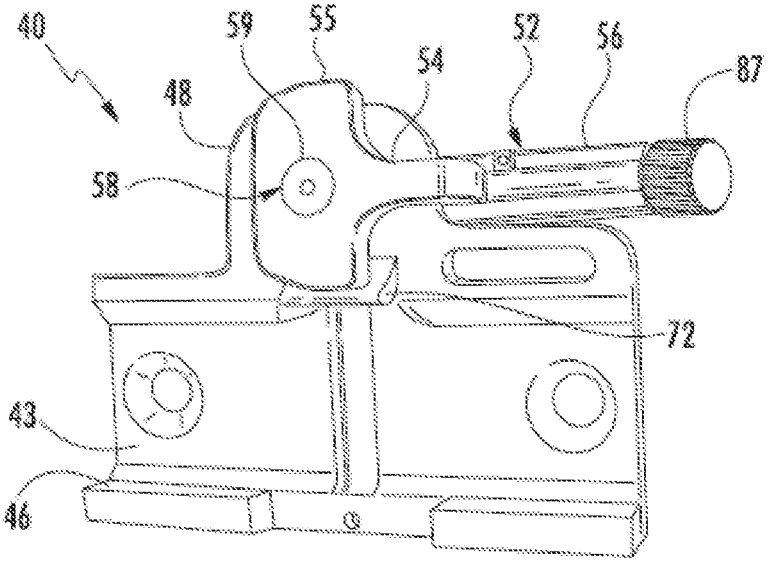
FIG. 6 is a bottom perspective view thereof with the actuator arm rotated to a closed position.
Figure 7:
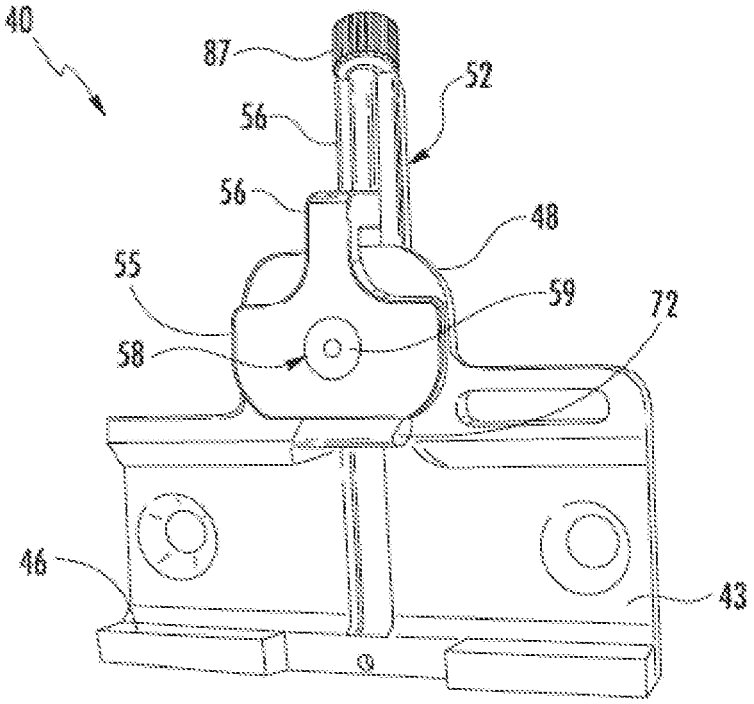
FIG. 7 is another bottom perspective view thereof with the actuator arm rotated to an open position.
Figure 8:
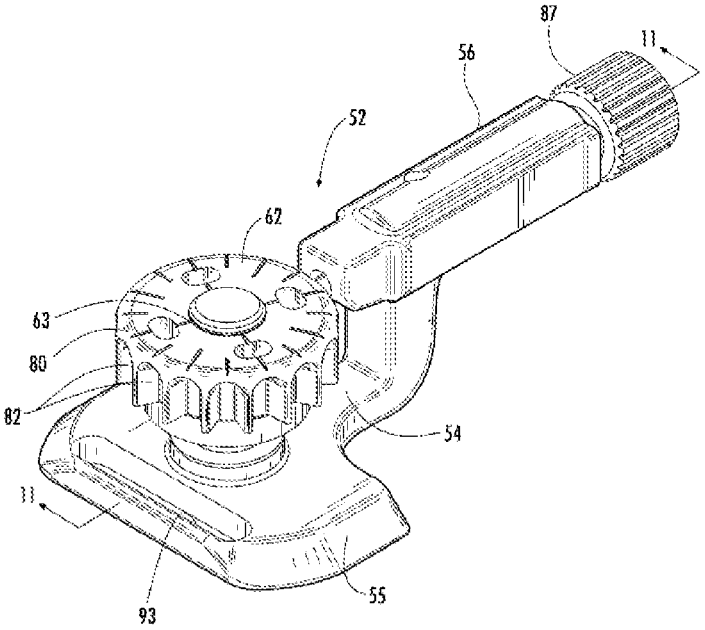
FIG. 8 is perspective view of a lever and foot of the mounting assembly in accordance with the teachings of the present invention.
Figure 9:
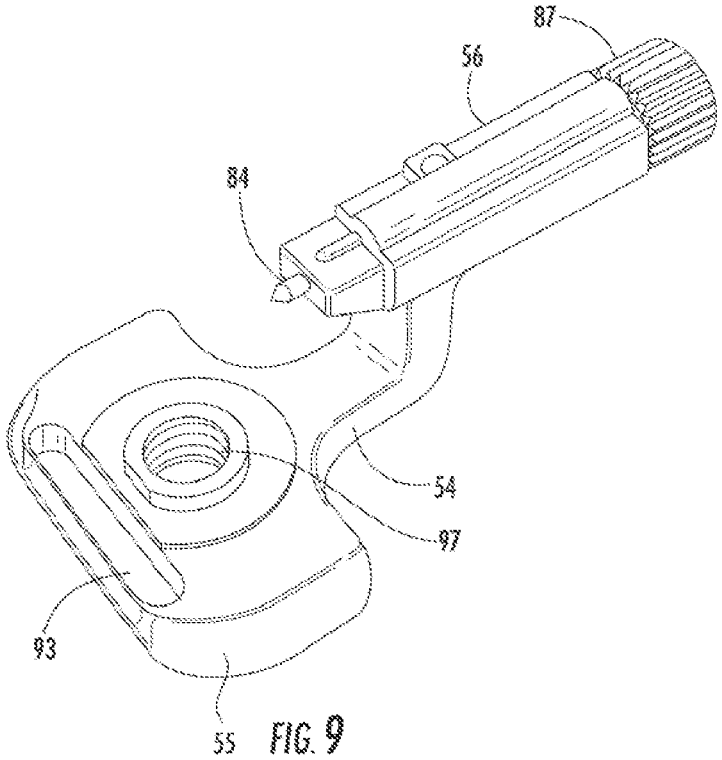
FIG. 9 is a top perspective view of actuator arm, illustrating the threaded bore through the molded foot portion.
Figure 10:
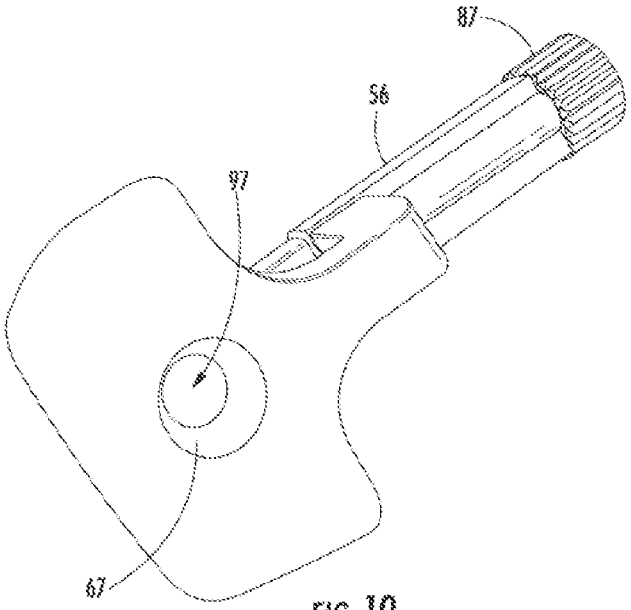
FIG. 10 is a bottom perspective view of the actuator arm, illustrating the threaded bore through the foot portion.
Figure 11:
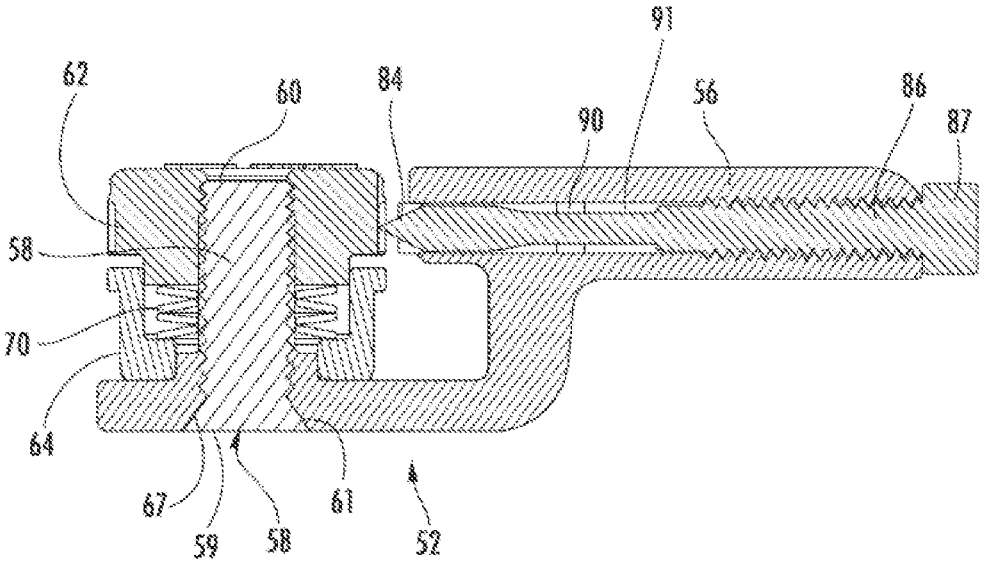
FIG. 11 is a cross-section view through line 11-11 of FIG. 8.
Figure 12:
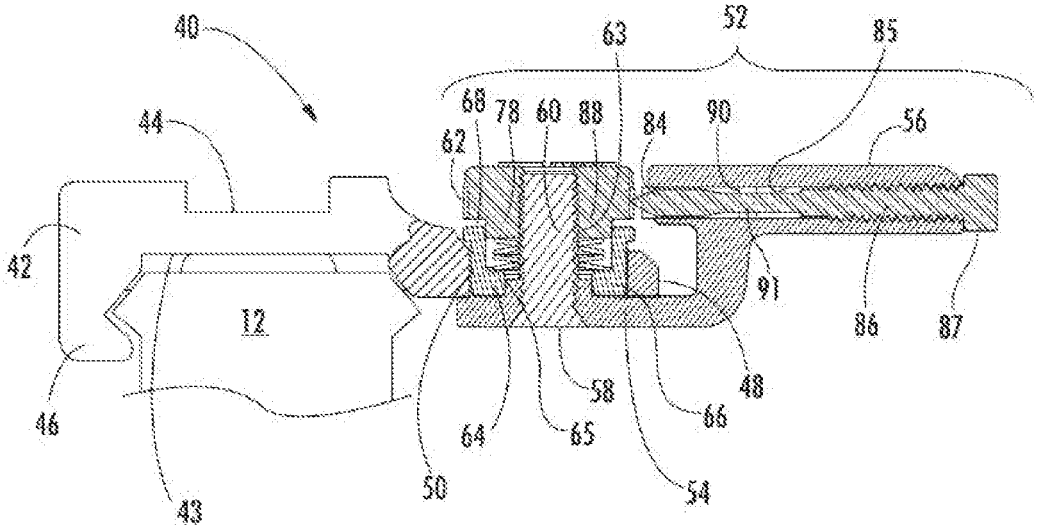
FIG. 12 is a partial cross-section view including the mount body.

A threaded governor post 58 is threadably received through a threaded bore 97 on the foot portion 54, and extends upwardly from the foot portion 54 through the smaller opening 65 in the bushing 64 and terminates in an end 60. Surrounding the threaded bore 97 is a raised shoulder which fits within the opening 65 in the bushing 64. The shoulder provided added strength and material to the mounting area in the foot while also centering the foot 54 within the bushing 64. Although stainless steel is indicated in the example, other high-tensile carbon steels of similar strength are also suitable. The threaded governor post 58 includes a head 59 with a beveled edge 61 that recesses flush into a bottom surface of the foot portion having a corresponding beveled surface 67 (as shown in FIGS. 10, 11). As best seen in FIGS. 6 and 7, the bottom surface of the head 59 includes a small Allen socket for tightening of the threaded post 58 into the threaded bore 97 in the foot 54. The combination of molded and turned parts provides ease of manufacture and cost savings while also providing superior strength and durability. The threaded, removable governor post 58 provides the ability to change the post material to increase overall component strength and to increase thread strength. The arrangement further simplifies field maintenance and repair in the event of damage and reduces repair costs by not having to replace the entire lever assembly.

At least one spring washer 70 is received around the threaded post 58 and is seated on an upper surface of the bottom wall 66 of the bushing 64 within a central recess 68. The spring washer 70 may be a Belleville spring although any other suitable disc-type springs would also fall within the scope of the invention. Further, a plurality of spring washers 70 may be utilized in series, in parallel or in a combination thereof in order to achieve the desired spring tension and deflection properties.

A retention nut 62 having a threaded bore 63 is threadedly received on the end 60 of the threaded post 58 such that the spring washer 70 is captured between the bottom surface of the retention nut and the upper surface of the bottom wall 66 of the bushing 64. The spring washer(s) 70 is/are compressed as the retention nut 62 is tightened thereby providing for adjustment of the spring tension of the clamping assembly 52.

There is also shown a steel buffer pad 72 having a flat horizontal base portion with an arm 74 at each end of the base extending upwardly at an oblique angle of 135 degrees. The free end of each arm 74 is curved approximately 150 degrees. Two side-by-side openings 76, corresponding in separation to the separation between buffer pad arms 74, are formed in the main body 42. The arms 74 of the buffer pad 72 are slid through the openings 76. In operation, the buffer element 72 sits between the angulated surface of the rail 12 and the cam surface 55 of the foot portion 54. Rotation of the actuator arm 56 causes the foot portion 54 to press the buffer element 72 into the side of the firearm rail 12. The buffer element 72 prevents the foot portion 54 from directly touching and thereby marring the outer surface of the firearm rail 12. Rotation of the actuator arm 56 and the consequent movement of the foot portion 54 against the buffer element 72 overcomes the resistance of the spring washers 70 and moves the buffer element 72 against the engagement surface of the rail interface 12.

To ensure that the retention nut 62 remains in a position as set by the user, the clamping assembly 52 further comprises a locking component for positively locking the position of the retention nut 62 on the threaded shaft 58. The locking component comprises at least one locking formation 82 (detent) on the outer edge surface 80 of the retention nut 62 and a threaded locking pin 87. As shown in FIGS. 8-12, the detents 82 extend all the way around the outer surface 80 of the retention nut 62 to provide a wide range of adjustment. The locking pin 87 is received within a bore 85 formed in the handle portion of the actuator arm 56. Threads 86 on the proximal end of the locking pin 87 adjacent a head portion of the locking pin engage complimentary threads within the bore 85 in the actuator arm 56. While the locking pin 87 can be displaced inwardly and outwardly relative to the actuator arm 56, the locking pin is further held within the bore another roll pin 90 extending across the bore 85 and across a shoulder region slot 91 formed on the locking pin 87. The shoulder region 91 provides a sufficient amount of travel for retraction and engagement of the pin 87 but prevents it from falling out.

Since the spring 70 is trapped between the retention nut 62 and the bushing 64, tightening of the retention nut 62 causes compression of the spring 70, shortens the range of the vertical travel of the foot portion 54 relative to the bottom surface of the boss 48 and increases the spring clamping force. Accordingly, when the actuator arm 56 rotates the foot portion 54 into engagement with the rail 12, additional spring pressure is exerted on dovetail rail 12. Similarly, as the retention nut 62 is loosened, the compression of the spring 70 is reduced, the range of vertical travel of the foot portion 54 is increased, and the clamping force is reduced.

In order to tighten or loosen the retention nut 62, the locking pin is unthreaded relative to the actuator arm 56 until the distal end 84 of the locking pin 87 is clear of the detents 82 in the retention nut 62 thereby allowing rotation of the retention nut 62 relative to the clamping assembly. After the retention nut 62 is adjusted and the desired spring tension is set, the locking pin 87 is threaded back into the bore 85 such that the distal end 84 of the locking pin 87 engages one of the detents 82 on the retention nut 62 preventing rotation of the retention nut 62 relative to the clamping assembly 52.

It can further be appreciated that the head at the proximal end of the locking pin 87 includes a texturing or knurling thereon as well as an increased diameter to facilitate turning of the locking pin 87 by hand.

Figure 13:
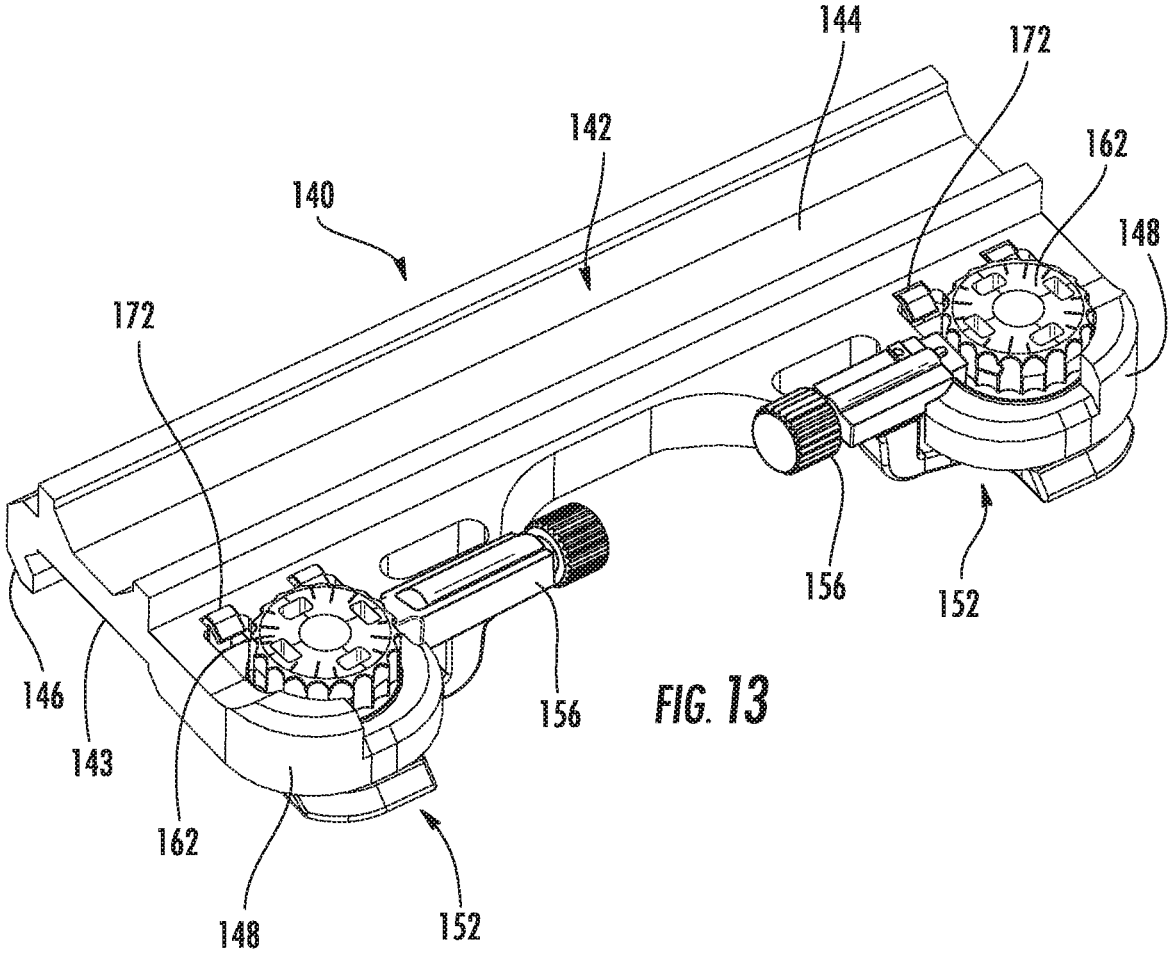
FIGS. 13-14 are top perspective views of an alternative dual lever embodiment in accordance with the teachings of the present invention.
Figure 14:
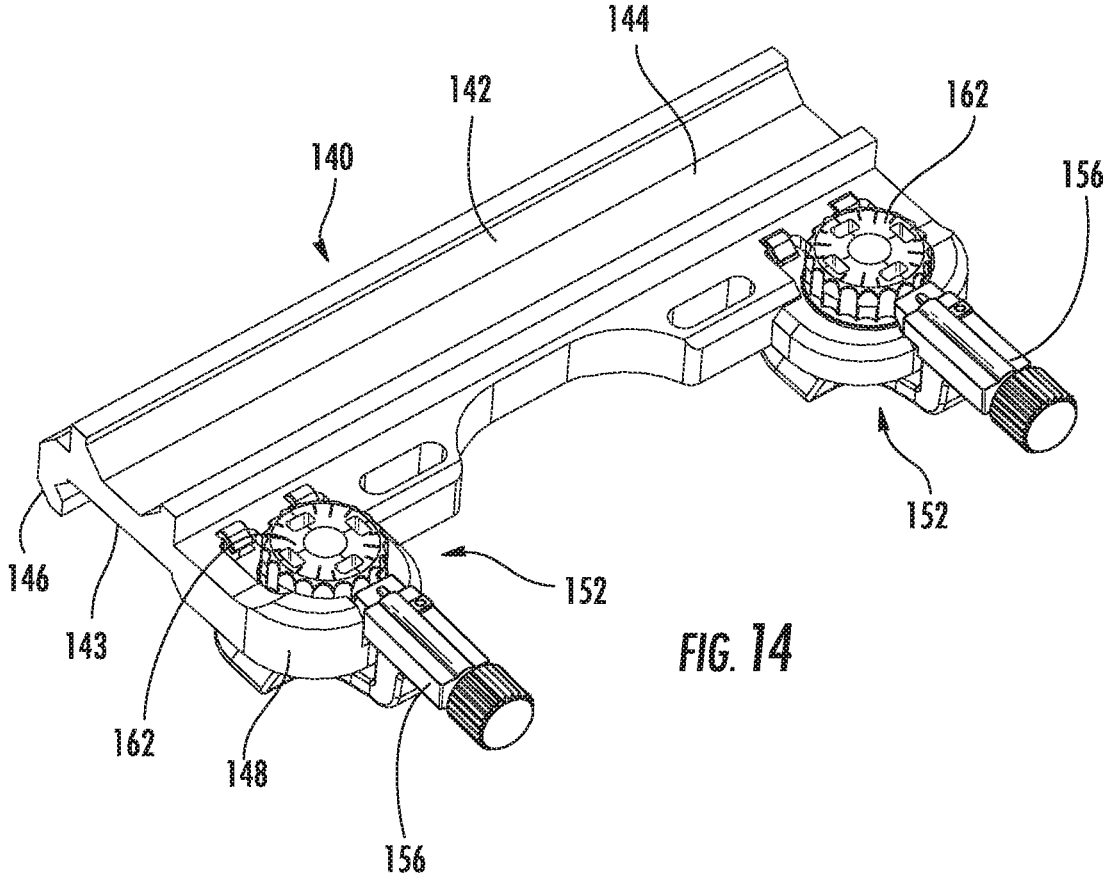

Turning to FIGS. 13 and 14, an alternative embodiment of a mounting assembly 140 is shown having dual clamping assemblies 152. Like the first embodiment described above, the alternative embodiment, shown generally at 140, includes a main body 142 having a lower portion 143 that is configured to engage the dovetail rail 12 found on most modern combat weapons 2 and an upper portion 44 that can take on a variety of configurations depending on the accessory that is to be mounted thereon. The lower portion 143 of the main body 142 has a first engagement member 146 extending downwardly along one side thereof for engaging one side of the dovetail rail 12. Opposite the first engagement member 146, are dual, opposing boss formations 148. The boss formations 148 are provided adjacent the side of the main body 142 wherein the boss formations 148 receive opposing clamping assemblies generally indicated at 152, having actuator arms 156 that may be rotated between closed (FIG. 13) and open (FIG. 14) positions. The mounting assembly may further include buffer pages 172 as well. In all other respects, the alternative embodiment 140 is identical in construction to the first embodiment 40 described above.

Accordingly, it can be seen that the present invention provides a unique and novel modular accessory mount that fills a critical need for soldiers in the field as well as civilian shooters, by ensuring positive and reliable operation. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A mounting assembly for attaching an accessory to a dovetail rail interface, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a foot portion positioned adjacent a bottom surface of said boss formation, said foot portion including a cam surface and a threaded bore;

an actuator arm extending outwardly from said foot portion;

a threaded governor post threadably received through the threaded bore of said foot portion and extending upwardly through said opening in said boss formation;

a spring received around said threaded governor post adjacent a top surface of said boss formation;

a retention nut threadedly received on said threaded governor post such that said spring is captured between a bottom surface of said retention nut and the top surface of said boss formation; and wherein the foot portion is formed from a first material and the threaded governor post is formed from a second material, where the first material is different than the second material.

2. The mounting assembly of claim 1, wherein said clamping assembly further comprises a bushing received within said opening in said boss formation, said bushing including an opening, said threaded governor post of said clamping assembly extending through said opening in said bushing, said spring being captured between the bottom surface of said retention nut and a top surface of said bushing.

3. The mounting assembly of claim 1, wherein said boss formation includes a shoulder formation configured and arranged to prevent rotation of said actuator arm beyond a disengaged position.

4. The mounting assembly of claim 1, wherein said threaded governor post includes a head.

5. The mounting assembly of claim 4, wherein said head of said threaded governor post includes a beveled edge.

6. The mounting assembly of claim 5, wherein said head of said threaded governor post is flush with a bottom surface of said foot portion.

7. The mounting assembly of claim 6, wherein said foot portion includes a recessed surface around said threaded bore.

8. The mounting assembly of claim 7, wherein said recessed surface around said threaded bore includes a beveled surface.

9. The mounting assembly of claim 1, wherein the threaded governor post is formed from stainless steel.

10. A mounting assembly for attaching an accessory to a dovetail rail interface, said mounting assembly comprising:

an actuator arm including a foot portion having a cam surface, a threaded bore, and an arm portion extending from said foot portion;

a governor post threaded along an entire length thereof from a proximal end to a distal end, said governor post being threadably received through and threadably engaged with said threaded bore of said foot portion, a spring received around said threaded governor post;

a retention nut threadedly received on said threaded governor post;

wherein the foot portion is formed from a first material and the threaded governor post is formed from a second material, where the first material is different than the second material.

11. The mounting assembly of claim 10, wherein said threaded governor post includes a head extending from one of the proximal or distal ends.

12. The mounting assembly of claim 11, wherein said head of said threaded governor post includes a beveled edge.

13. The mounting assembly of claim 12, wherein said head of said threaded governor post is flush with a bottom surface of said foot portion.

14. The mounting assembly of claim 13, wherein said foot portion includes a recessed surface around said threaded bore.

15. The mounting assembly of claim 14, wherein said recessed surface around said threaded bore includes a beveled surface.

16. The mounting assembly of claim 10, wherein the threaded governor post is formed from stainless steel.

17. A mounting assembly for attaching an accessory to a dovetail rail interface on a firearm, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a foot portion positioned adjacent a bottom surface of said boss formation, said foot portion including a cam surface and a threaded bore;

an actuator arm extending outwardly from said foot portion;

a governor post having a head and a post threaded along an entire length thereof, the governor post being threadably received through and threadably engaged with the threaded bore of said foot portion such that the head engages a bottom surface of the foot portion and the post extends upwardly through said opening in said boss formation, the governor post being fixed relative to said foot portion such that the governor post is rotatable with said foot portion when assembled therewith;

a spring received around said governor post adjacent a top surface of said boss formation;

a retention nut threadedly received on said governor post such that said spring is captured between a bottom surface of said retention nut and the top surface of said boss formation; and wherein the foot portion is formed from a first material and the threaded governor post is formed from a second material, where the first material is different than the second material.

18. The mounting assembly of claim 17, wherein the threaded governor post is formed from stainless steel.

* * * * *